US008550716B2

(12) United States Patent
Smith et al.

(10) Patent No.: US 8,550,716 B2
(45) Date of Patent: Oct. 8, 2013

(54) TACTILE ENHANCEMENT MECHANISM FOR A CLOSURE MECHANISM

(75) Inventors: Leland J. Smith, Midland, MI (US); James C. Pawloski, Racine, WI (US); Lawrence C. Stanos, Midland, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 170 days.

(21) Appl. No.: 13/029,747

(22) Filed: Feb. 17, 2011

(65) Prior Publication Data

US 2011/0311169 A1 Dec. 22, 2011

Related U.S. Application Data

(63) Continuation-in-part of application No. 12/820,680, filed on Jun. 22, 2010, now Pat. No. 8,469,592.

(51) Int. Cl.
*B65D 33/16* (2006.01)

(52) U.S. Cl.
USPC ..... 383/63; 383/65

(58) Field of Classification Search
USPC ..... 383/63–65; 24/585.12, 30.5 R, 399, 400
See application file for complete search history.

(56) References Cited

U.S. PATENT DOCUMENTS

| | | | |
|---|---|---|---|
| 2,035,674 | A | 3/1936 | Sipe |
| 2,822,012 | A | 2/1958 | Gold |
| 3,338,284 | A | 8/1967 | Ausnit |
| 3,381,592 | A | 5/1968 | Ravel |
| 3,416,585 | A | 12/1968 | Staller |
| 3,565,147 | A | 2/1971 | Ausnit |
| RE27,174 | E | 9/1971 | Ausnit |
| 3,937,395 | A | 2/1976 | Lawes |
| RE28,969 | E | 9/1976 | Naito |
| 4,186,786 | A | 2/1980 | Kirkpatrick |
| 4,191,076 | A | 3/1980 | Bollmer et al. |
| 4,285,105 | A | 8/1981 | Kirkpatrick |
| 4,285,376 | A | 8/1981 | Ausnit |
| 4,363,345 | A | 12/1982 | Scheibner |

(Continued)

FOREIGN PATENT DOCUMENTS

| | | | |
|---|---|---|---|
| DE | 1226817 B | | 10/1966 |
| DE | 2504863 A1 | | 8/1976 |
| JP | 2005126071 A | * | 5/2005 |
| WO | 8600867 A1 | | 2/1986 |

OTHER PUBLICATIONS

Printout of website page "http://www.perdue.com/products/subcategory-features.html?category_id=29" on Dec. 1, 2010.

(Continued)

*Primary Examiner* — Jes F Pascua

(57) ABSTRACT

A pouch including opposing sidewalls sealed together in a closed distal portion to form an interior that is accessible by a proximal opening. A closure profile extends along an interior surface of the opposing sidewalls for selectively sealing the proximal opening, wherein the closure profile substantially extends a length of the proximal opening. A plurality of tactile strips are disposed on an interior surface of at least one of the opposing sidewalls between the closure profile and the proximal opening, the tactile strips being variably spaced. Preferably, each tactile strip has a well-formed triangular cross-sectional shape with a height from the respective sidewall approximately double a thickness of the respective sidewall.

8 Claims, 6 Drawing Sheets

(56) References Cited

U.S. PATENT DOCUMENTS 4,372,014 A 2/1983 Simpson
4,419,159 A 12/1983 Herrington
4,428,788 A 1/1984 Kamp
4,479,244 A 10/1984 Ausnit
4,484,352 A 11/1984 Katzin
4,515,647 A 5/1985 Behr
4,522,678 A 6/1985 Zieke
4,532,652 A 7/1985 Herrington
4,555,282 A 11/1985 Yano
4,561,108 A 12/1985 Kamp
4,561,109 A 12/1985 Herrington
4,562,027 A 12/1985 Behr et al.
4,578,813 A 3/1986 Ausnit
4,586,319 A 5/1986 Ausnit
4,615,045 A 9/1986 Siegel
4,618,383 A 10/1986 Herrington
4,655,862 A 4/1987 Christoff et al.
4,672,723 A 6/1987 Hugues et al.
4,673,383 A 6/1987 Bentsen
4,676,851 A 6/1987 Scheibner et al.
4,683,015 A 7/1987 Wagers
4,698,118 A 10/1987 Takahashi
4,701,358 A 10/1987 Behr et al.
4,709,399 A 11/1987 Sanders
4,709,400 A 11/1987 Bruno
4,710,968 A 12/1987 Borchardt et al.
4,736,451 A 4/1988 Ausnit
4,736,496 A 4/1988 Fisher et al.
4,741,789 A 5/1988 Zieke et al.
4,755,248 A 7/1988 Geiger et al.
4,764,977 A 8/1988 Wagers
4,787,880 A 11/1988 Ausnit
4,788,282 A 11/1988 Deziel
4,791,710 A 12/1988 Nocek et al.
4,792,240 A 12/1988 Ausnit
4,796,300 A 1/1989 Branson
4,812,056 A 3/1989 Zieke
4,812,192 A 3/1989 Woods et al.
4,822,539 A 4/1989 Tilman et al.
4,829,641 A 5/1989 Williams
4,832,768 A 5/1989 Takahashi
4,834,554 A 5/1989 Stetler, Jr. et al.
4,846,586 A 7/1989 Bruno
4,859,259 A 8/1989 Scheibner
4,869,725 A 9/1989 Schneider et al.
4,898,492 A 2/1990 Janowski
4,906,310 A 3/1990 Broderick et al.
4,907,321 A 3/1990 Williams
4,923,701 A 5/1990 VanErden
4,941,238 A 7/1990 Clark
4,964,739 A 10/1990 Branson et al.
5,009,828 A 4/1991 McCree
5,012,561 A 5/1991 Porchia et al.
5,017,021 A 5/1991 Simonsen et al.
5,022,530 A 6/1991 Zieke
5,023,122 A 6/1991 Boeckmann et al.
RE33,674 E 8/1991 Uramoto
5,049,223 A 9/1991 Dais et al.
5,053,091 A 10/1991 Giljam et al.
5,056,933 A 10/1991 Kamp
5,067,822 A 11/1991 Wirth et al.
5,070,584 A 12/1991 Dais et al.
5,092,684 A 3/1992 Weeks
5,138,750 A 8/1992 Gundlach et al.
5,140,727 A 8/1992 Dais et al.
5,141,577 A 8/1992 Porchia et al.
5,154,086 A 10/1992 Porchia et al.
5,167,454 A 12/1992 Woods et al.
5,184,896 A 2/1993 Hammond et al.
5,186,543 A 2/1993 Cochran
5,192,135 A 3/1993 Woods et al.
5,198,055 A 3/1993 Wirth et al.
5,209,574 A 5/1993 Tilman
5,211,481 A 5/1993 Tilman
5,235,731 A 8/1993 Anzai et al.
5,238,306 A 8/1993 Heintz et al.
5,248,201 A 9/1993 Kettner et al.
5,252,281 A 10/1993 Kettner et al.
5,259,904 A 11/1993 Ausnit
5,273,511 A 12/1993 Boeckman
5,307,552 A 5/1994 Dais et al.
5,326,176 A 7/1994 Domke
5,345,659 A 9/1994 Allan
5,356,222 A 10/1994 Kettner et al.
5,358,334 A 10/1994 Simonsen
5,366,294 A 11/1994 Wirth et al.
5,368,394 A 11/1994 Scott et al.
5,369,847 A 12/1994 Naya et al.
5,382,094 A 1/1995 Ausnit
5,384,942 A 1/1995 Siegel
5,388,910 A 2/1995 Koyanagi
5,397,182 A 3/1995 Gaible et al.
5,403,094 A 4/1995 Tomic
5,405,561 A 4/1995 Dais et al.
5,415,904 A 5/1995 Takubo et al.
5,462,360 A 10/1995 Tilman et al.
5,474,382 A 12/1995 May
5,478,228 A 12/1995 Dais et al.
5,492,705 A 2/1996 Porchia et al.
5,509,734 A 4/1996 Ausnit
5,511,884 A 4/1996 Bruno et al.
5,525,363 A 6/1996 Herber et al.
5,527,112 A 6/1996 Dais et al.
5,540,500 A 7/1996 Tanaka
5,558,493 A 9/1996 Hayashi et al.
5,564,834 A 10/1996 Porchia et al.
5,575,747 A 11/1996 Dais et al.
5,577,305 A 11/1996 Johnson
5,588,187 A 12/1996 Swain
5,611,627 A 3/1997 Belias et al.
5,618,111 A 4/1997 Porchia et al.
5,647,100 A 7/1997 Porchia et al.
5,655,273 A 8/1997 Tomic et al.
5,660,479 A 8/1997 May et al.
5,664,299 A 9/1997 Porchia et al.
5,669,715 A 9/1997 Dobreski et al.
5,672,009 A 9/1997 Malin
5,686,126 A 11/1997 Noel et al.
5,689,866 A 11/1997 Kasai et al.
5,704,670 A 1/1998 Surplus
5,711,609 A 1/1998 Simonsen
5,713,669 A 2/1998 Thomas et al.
5,718,024 A 2/1998 Robbins
5,720,557 A 2/1998 Simonsen
5,722,128 A 3/1998 Toney et al.
5,729,876 A 3/1998 Johnson
5,747,126 A 5/1998 Van Erden et al.
5,749,658 A 5/1998 Kettner
5,759,648 A * 6/1998 Idlas ..... 428/34.9
5,769,772 A 6/1998 Wiley
5,774,955 A 7/1998 Borchardt et al.
5,775,812 A 7/1998 St. Phillips et al.
5,783,012 A 7/1998 Porchia et al.
5,791,783 A 8/1998 Porchia et al.
5,794,315 A 8/1998 Crabtree et al.
5,804,265 A 9/1998 Saad et al.
5,809,621 A 9/1998 McCree et al.
5,817,380 A 10/1998 Tanaka
5,827,163 A 10/1998 Kettner
5,832,145 A 11/1998 Dais et al.
5,832,570 A 11/1998 Thorpe et al.
5,836,056 A 11/1998 Porchia et al.
5,839,831 A 11/1998 Mazzocchi
D406,685 S 3/1999 McGinnis
5,878,468 A 3/1999 Tomic et al.
5,902,046 A 5/1999 Shibata
5,911,508 A 6/1999 Dobreski et al.
5,927,855 A 7/1999 Tomic et al.
5,930,877 A 8/1999 Thorpe et al.
5,933,927 A 8/1999 Miller et al.
5,934,806 A 8/1999 Tomic et al.
5,950,285 A 9/1999 Porchia et al.
5,953,796 A 9/1999 McMahon et al.
5,955,160 A 9/1999 Tanaka et al.

(56) References Cited

U.S. PATENT DOCUMENTS 5,964,532 A 10/1999 St. Phillips et al.
5,967,663 A 10/1999 Vaquero et al.
5,988,880 A 11/1999 Tomic
6,009,603 A 1/2000 Gallagher
6,010,244 A 1/2000 Dobreski et al.
6,014,795 A 1/2000 McMahon et al.
6,030,122 A 2/2000 Ramsey et al.
6,032,437 A 3/2000 Bois
6,050,726 A 4/2000 Hoerl
6,071,011 A 6/2000 Thomas et al.
6,074,096 A 6/2000 Tilman
6,077,208 A 6/2000 Larkin et al.
6,080,252 A 6/2000 Plourde
6,110,586 A 8/2000 Johnson
6,112,374 A 9/2000 Van Erden
6,135,636 A 10/2000 Randall
6,138,329 A 10/2000 Johnson
6,139,186 A 10/2000 Fraser
6,148,588 A 11/2000 Thomas et al.
6,149,302 A 11/2000 Taheri
6,152,600 A 11/2000 Tomic
6,156,363 A 12/2000 Chen et al.
6,164,825 A 12/2000 Larkin et al.
6,167,597 B1 1/2001 Malin
6,170,696 B1 1/2001 Tucker et al.
6,170,985 B1 1/2001 Shabram, Jr. et al.
6,187,396 B1 2/2001 Moller
6,210,038 B1 4/2001 Tomic
6,217,215 B1 4/2001 Tomic
6,217,216 B1 4/2001 Taheri
6,220,754 B1 4/2001 Stiglic et al.
6,221,484 B1 4/2001 Leiter
6,228,484 B1 5/2001 Willert-Porada et al.
6,228,485 B1 5/2001 Leiter
6,231,236 B1 5/2001 Tilman
6,257,763 B1 7/2001 Stolmeier et al.
6,279,298 B1 8/2001 Thomas et al.
6,286,681 B1 9/2001 Wilfong, Jr. et al.
6,286,999 B1 9/2001 Cappel et al.
6,293,701 B1 9/2001 Tomic
6,299,353 B1 10/2001 Piechocki et al.
6,318,894 B1 11/2001 Derenthal
6,321,423 B1 11/2001 Johnson
6,360,513 B1 3/2002 Strand et al.
6,371,643 B2 4/2002 Saad et al.
6,386,762 B1 5/2002 Randall et al.
6,394,652 B2 5/2002 Meyer et al.
6,398,411 B2 6/2002 Metzger
6,443,617 B2 9/2002 Tetenborg
6,461,042 B1 10/2002 Tomic et al.
6,461,043 B1 10/2002 Healy et al.
6,481,890 B1 11/2002 VandenHeuvel
6,487,758 B2 12/2002 Shaffer et al.
6,491,433 B2 12/2002 Shabram, Jr. et al.
6,539,594 B1 4/2003 Kasai et al.
6,550,965 B2 4/2003 Shaffer et al.
6,550,966 B1 4/2003 Saad et al.
6,553,740 B2 4/2003 Delisle
6,571,430 B1 6/2003 Savicki et al.
6,574,939 B1 6/2003 Heijnen et al.
6,581,249 B1 6/2003 Savicki et al.
6,582,122 B2 6/2003 Shimizu
6,592,260 B1 7/2003 Randall et al.
6,594,872 B2 7/2003 Cisek
6,637,937 B2 10/2003 Bois
6,637,939 B2 10/2003 Huffer
6,686,005 B2 2/2004 White et al.
6,691,383 B2 2/2004 Linton
6,692,147 B2 2/2004 Nelson
6,703,046 B2 3/2004 Fitzhugh et al.
6,712,509 B2 3/2004 Cappel
6,786,712 B2 9/2004 Cisek
6,789,946 B2 9/2004 Plourde et al.
6,854,886 B2 2/2005 Piechocki et al.
6,874,938 B2 4/2005 Price et al.
6,877,898 B2 4/2005 Berich et al.
6,953,542 B2 10/2005 Cisek
6,954,969 B1 10/2005 Sprehe
6,955,465 B2 10/2005 Machacek et al.
6,962,439 B2 11/2005 Taheri
6,994,535 B2 2/2006 Pawloski
7,004,632 B2 2/2006 Hamilton et al.
7,017,240 B2 3/2006 Savicki
7,036,988 B2 5/2006 Olechowski
7,137,736 B2 11/2006 Pawloski et al.
7,163,706 B2 1/2007 Shepard et al.
RE39,505 E 3/2007 Thomas et al.
7,234,865 B2 6/2007 Piechocki
7,241,046 B2 7/2007 Piechocki et al.
7,260,871 B2 8/2007 Borchardt et al.
7,270,479 B2 9/2007 Nelson
7,305,742 B2 12/2007 Anderson
7,322,747 B2 1/2008 Borchardt
7,334,682 B2 2/2008 Goepfert
7,347,624 B2 3/2008 Savicki, Sr. et al.
RE40,284 E 5/2008 Thomas et al.
7,410,298 B2 8/2008 Pawloski
7,437,805 B2 10/2008 Berich
7,517,484 B2 4/2009 Wu
7,534,039 B2 5/2009 Wu
7,543,361 B2 6/2009 Borchardt et al.
7,553,082 B2 6/2009 Yoder
7,585,111 B2 9/2009 Turvey et al.
7,651,271 B2 1/2010 Withers
7,674,039 B2 3/2010 McMahon et al.
7,674,040 B2 * 3/2010 Dowd et al. ..... 383/61.2
7,736,058 B2 6/2010 Tanaka et al.
8,215,839 B2 * 7/2012 Borchardt et al. ..... 383/63
8,469,592 B2 * 6/2013 Pawloski ..... 383/63
2002/0064582 A1 5/2002 Carabetta et al.
2002/0090151 A1 7/2002 Skeens et al.
2002/0153273 A1 10/2002 Mallik et al.
2002/0173414 A1 11/2002 Leighton
2003/0169948 A1 9/2003 Fenzl et al.
2003/0177619 A1 9/2003 Cisek
2003/0210836 A1 11/2003 Strand
2003/0223654 A1 12/2003 Gerrits
2003/0223657 A1 12/2003 Belias et al.
2003/0232112 A1 12/2003 Whitmore et al.
2003/0236158 A1 * 12/2003 Pawloski et al. ..... 493/394
2004/0001651 A1 1/2004 Pawloski
2004/0078939 A1 4/2004 Pawloski
2004/0078940 A1 4/2004 Ishizaki
2004/0131283 A1 7/2004 Sprague et al.
2004/0234171 A1 11/2004 Dais et al.
2004/0234173 A1 11/2004 Saad et al.
2004/0256761 A1 12/2004 Pawloski
2005/0063616 A1 3/2005 Chang
2005/0141786 A1 6/2005 Piechocki et al.
2005/0207679 A1 9/2005 Armstrong
2005/0271308 A1 12/2005 Pawloski
2005/0276524 A1 12/2005 Taheri
2005/0281921 A1 12/2005 Langston et al.
2005/0286810 A1 12/2005 Sprague et al.
2005/0286811 A1 12/2005 Sprague et al.
2005/0286812 A1 12/2005 Sprague et al.
2006/0008187 A1 1/2006 Armstrong
2006/0078232 A1 4/2006 Trinko
2006/0165316 A1 7/2006 Cheung
2006/0257533 A1 11/2006 Plourde et al.
2007/0183692 A1 8/2007 Pawloski
2007/0206888 A1 9/2007 Chang
2008/0137995 A1 6/2008 Fraser et al.
2008/0159662 A1 7/2008 Dowd et al.
2008/0226202 A1 9/2008 Dais et al.
2008/0226203 A1 9/2008 Dais et al.
2008/0232722 A1 9/2008 Pawloski et al.
2008/0285897 A1 11/2008 Taheri
2008/0292222 A1 11/2008 Snoreck
2009/0034885 A1 2/2009 McGruder
2009/0052809 A1 2/2009 Sampson
2009/0097781 A1 4/2009 Tang
2009/0190860 A1 7/2009 Kettner et al.
2009/0214141 A1 8/2009 Borchardt et al.

(56) References Cited

U.S. PATENT DOCUMENTS

| | | | | |
|---|---|---|---|---|
| 2009/0232421 | A1 | 9/2009 | Turvey | |
| 2009/0257685 | A1 | 10/2009 | Matias | |
| 2009/0300891 | A1* | 12/2009 | Nanba et al. | 24/399 |
| 2009/0304311 | A1 | 12/2009 | Noguchi et al. | |
| 2010/0014786 | A1 | 1/2010 | Pawloski et al. | |
| 2010/0166341 | A1 | 7/2010 | McMahon et al. | |
| 2011/0299797 | A1* | 12/2011 | Petkovsek | 383/64 |
| 2012/0275730 | A1* | 11/2012 | Katada et al. | 383/202 |

OTHER PUBLICATIONS

Printout of website page "http://www.daymarksafety.com/deptitern/I/P342/n/8.5_x_8.5%22_Day_of_the_Week_Bags/" on Dec. 1, 2010.

Printout of website page "http://www.daymarksafety.com/deptitern/I/P243/n/Acrylic_Portion_Bag_Dispenser/" on Dec. 1, 2010.

Printout of webstie page "http://www.glad.com.au/glad-products/food-management/glad-go-between/" on Dec. 14, 2010.

* cited by examiner

TACTILE ENHANCEMENT MECHANISM FOR A CLOSURE MECHANISM

CROSS REFERENCE TO RELATED APPLICATIONS

This application claims priority, as a continuation-in-part, to U.S. Utility patent application Ser. No. 12/820,680, filed Jun. 22, 2010, now U.S. Pat. No. 8,469,592, which is incorporated herein by reference.

BACKGROUND

1. Field of the Invention

The present disclosure generally relates to tactile enhancement mechanisms for closure mechanisms of resealable pouches.

2. Description of the Background of the Invention

Resealable pouches in the form of thermoplastic bags with elongate closure mechanisms have been developed of a type that includes one or more sets of closure mechanisms, such as interlocking closure profiles, for maintaining the pouch in a sealed condition. In some pouches, these closure profiles may be difficult for a user to locate and/or operate such that the pouch cannot be occluded properly because the user is unable to visually see the closure profiles and/or is unable to easily feel the location of the closure profiles. In such cases, incomplete occlusion does not allow the pouch to be sealed properly and the contents of the pouch may escape or spoil.

Various attempts have been made to help users locate and properly occlude closure profiles. For example, one design provides a reclosable bag having front and rear walls and a single pair of mutually interlocking opposing rib and groove closure elements disposed across a mouth of the bag. Outer surfaces of the walls are roughened coextensive with and over the rib and groove elements by a series of vertical ridges with vertical valleys therebetween to facilitate a user's application of tangential force to open the closure elements.

Another design provides a reclosable bag having alignment ribs disposed on opposite sides of a male interlocking profile on an interior side of a first bag wall. Outer ridge beams coextensive with a central stabilizing ridge are extruded on the first bag wall exterior surface opposite the alignment ribs and the male interlocking profile, respectively.

A further design provides a reclosable bag having front and rear walls and nested inner and outer closure mechanisms disposed on interior surfaces of the walls. A pair of parallel spaced apart ribs is disposed on an external surface of the front wall and is aligned with legs of an outer female interlocking member. Another pair of parallel ribs is disposed on an external surface of the rear wall spaced on opposite sides of an inner female interlocking member.

Yet another design provides a reclosable bag having opposing walls and a single pair of mutually interlocking opposing rib and groove closure elements disposed across an interior of a mouth of the bag. Backing areas made of material that is dissimilar to the closure elements are provided on the bag walls in alignment with the closure elements on exterior surfaces of the opposing bag walls or between the closure elements and the bag walls. The dissimilar material of the backing areas provides a noticeable tactile feel for a user in regard to other areas of the bag in order to help the user feel the location of the closure elements.

Many designs found in the art include a guiding mechanism disposed directly opposite the closure profile such that a ridge is located on a back side of the closure profile and a user is able to position his or her fingers on the ridge to help guide occlusion. A problem with such designs however is that a user's finger may slide off of the ridge of material, which may cause uneven or incomplete occlusion along an entire length of the opening into the bag, thereby forming an incomplete seal across the opening.

To further improve upon a user's ability to open and close such resealable pouches, several mechanisms have also been developed to effectively grip the panels at the opening of the pouches and/or near the closure profile. For example, U.S. Pat. No. 7,651,271 to Withers discloses a reclosable bag with closure means consisting of a rib that engages a groove to selectively seal the bag. Shallow ribs are formed by extrusion on the internal surfaces to allow secure gripping of the bag panels. Two parallel spaced pairs of strengthening ribs are also extruded along both sides of the closure means to bear some of the forces applied to the sealing means to minimize breaking of the bag.

U.S. Pat. No. 5,209,574 to Tilman discloses a reclosable bag with male and female profiles on internal surfaces of the bag walls to create a zipper. Pairs of ribs are on each side of the profiles, respectively. The rib pairs form valleys that are sized and shaped to act as finger guides. A plurality of gripping ribs 36, 38 are formed on external surfaces of the walls. The ribs are offset with respect to each other and angled towards the profiles.

U.S. Pat. No. 5,839,831 to Mazzocchi discloses a flexible bag with gripper ridges. Each gripper ridge has opposing first and second walls that are normal to the bag wall. The first wall is longer than the second wall such that the end surface extending therebetween is angled and forms a gripping end or point.

SUMMARY

Despite the advancements above, a need exists for an improved tactile enhancement mechanism that aids in opening and closing the pouch to more easily store and remove items. The subject technology also provides an improved tactile enhancement mechanism that is easier to manufacture.

According to one aspect, a pouch includes a closure strip along an interior surface of a pouch sidewall for sealing an opening into the pouch. The closure strip extends from one end of the opening to an opposite end of the opening. A first tactile strip is disposed on an exterior surface of the pouch sidewall spaced above the closure profile, and a second tactile strip is disposed on the exterior surface of the pouch sidewall spaced below the closure profile. Each of the first and second tactile strips extends substantially to opposite ends of the closure mechanism, and an exterior of at least one of the first and second tactile strips is textured. A smooth region on the exterior surface of the first pouch sidewall is disposed opposite the closure mechanism extending completely between the first and second tactile strips.

Another aspect of the disclosure includes a tactile enhancement mechanism for a closure mechanism on a pouch, wherein the closure mechanism includes an elongate closure strip disposed on an interior surface of a sidewall of the pouch and extends from one end of a mouth into the pouch to another end of the mouth for closing the mouth. The tactile enhancement mechanism includes a first strip of material secured to the exterior surface of the sidewall below the closure strip and a second strip of material secured to the exterior surface of the sidewall above the closure profile. The first and second strips of material extend to opposite ends of the closure strip, and the first strip of material has a textured exposed surface. A smooth region on the exterior surface of the sidewall is coextensive with the closure strip between the first and second strips of material.

According to yet a further aspect, a reclosable pouch includes first and second opposing pouch walls defining an interior therebetween and an opening into the interior, an elongate resealable closure profile that extends longitudinally between opposite ends of the opening and includes a first closure member disposed on an interior surface of the first pouch wall, and first and second strips of material attached to an exterior surface of the first pouch wall. Each of the first and second strips of material is substantially parallel and immediately adjacent to the closure mechanism and includes a tactile pattern that forms a textured exterior surface. A region of the exterior surface that is disposed between the first and second regions and directly opposite the closure member is smooth.

In one embodiment, the subject technology is directed to a pouch including opposing sidewalls sealed together in a closed distal portion to form an interior that is accessible by a proximal opening. A closure profile extends along an interior surface of the opposing sidewalls for selectively sealing the proximal opening, wherein the closure profile substantially extends a length of the proximal opening. A plurality of tactile strips are disposed on an interior surface of at least one of the opposing sidewalls between the closure profile and the proximal opening, the tactile strips being variably spaced. Preferably, each tactile strip has a well-formed triangular cross-sectional shape with a height from the respective sidewall approximately double a thickness of the respective sidewall.

In another embodiment, the subject technology is directed to a method of forming tactile strips on a pouch including opposing sidewalls sealed together to form an interior that is accessible by an opening, and a closure strip along an interior surface of the opposing sidewalls for selectively sealing the opening. The method includes the steps of extruding a plurality of tactile strips in a die separately from forming the opposing sidewalls, applying the plurality of tactile strips on an exterior surface of at least one of the opposing sidewalls, the tactile strips being variably spaced between the closure strip and the opening, and forming the pouch.

Still another embodiment of the subject technology is a reclosable pouch including a first sidewall, a second sidewall opposing the first sidewall and sealed thereto to form a closed distal portion defining an interior that is accessible by a proximal opening. A closure profile extends along an interior surface of the opposing sidewalls for selectively sealing the proximal opening, wherein the closure profile substantially extends a length of the proximal opening. Three ridges are disposed on an interior surface of the first sidewall between the closure profile and the proximal opening, the three ridges being equally spaced apart. Four ridges are disposed on an interior surface of the second sidewall between the closure profile and the proximal opening, the four ridges being equally spaced apart, wherein two of the ridges on the second sidewall oppose and are equally spaced with respect to the opposing ridges on the first sidewall. The reclosable pouch may further include a fourth ridge on the first sidewall, the fourth ridge being a most proximally located ridge and at least 10% larger than each of the other ridges on the first sidewall as well as a fifth ridge on the second sidewall, the fifth ridge being a most proximally located ridge and at least 10% larger than each of the other ridges on the second sidewall.

It should be appreciated that the present technology can be implemented and utilized in numerous ways, including without limitation as a process, an apparatus, a system, a device, a method for applications now known and later developed. These and other unique features of the technology disclosed herein will become more readily apparent from the following description and the accompanying drawings.

DETAILED DESCRIPTION

Figure 1:
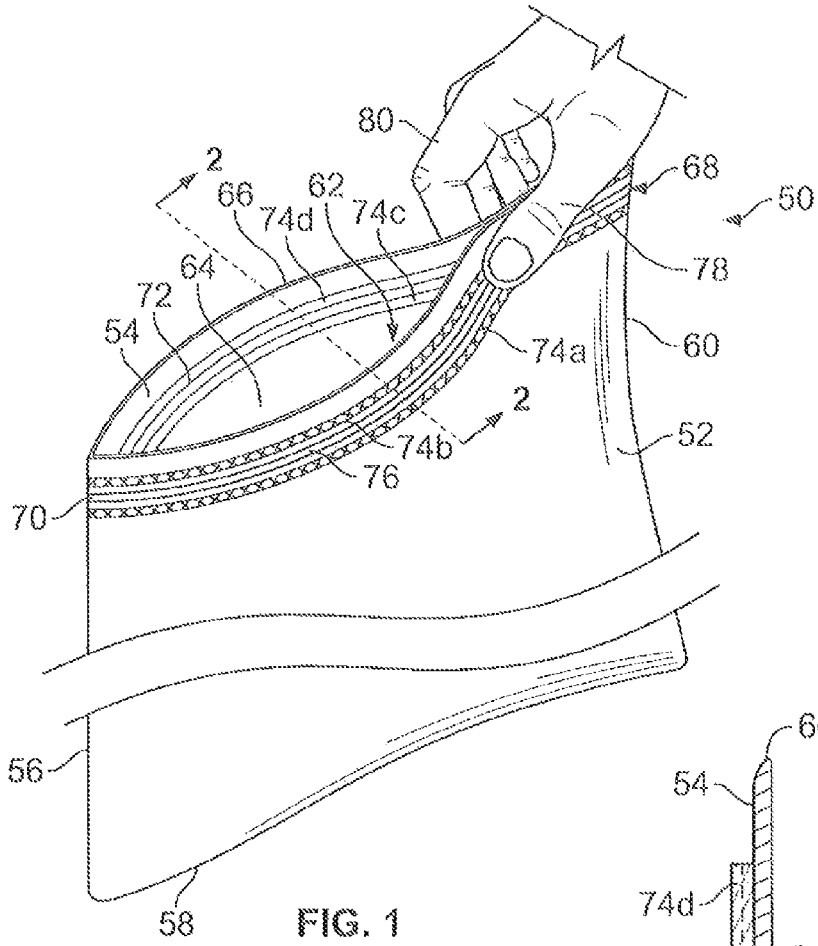
FIG. 1 is an isometric view of a pouch having a tactile enhancement mechanism of the present invention.

The present disclosure overcomes many of the prior art problems associated with utilizing storage bags and, specifically, tactile enhancement mechanisms for the same. The advantages and other features of the technology disclosed herein, will become more readily apparent to those having ordinary skill in the art from the following detailed description of certain preferred embodiments taken in conjunction with the drawings which set forth representative embodiments of the present invention and wherein like reference numerals identify similar structural elements. Unless otherwise specified, the illustrated embodiments can be understood as providing exemplary features of varying detail of certain embodiments, and therefore, unless otherwise specified, features, components, modules, elements, and/or aspects of the illustrations can be otherwise modified, combined, interconnected, sequenced, separated, interchanged, positioned, and/or rearranged without materially departing from the disclosed systems or methods. It is also noted that the accompanying drawings are somewhat idealized in that, for example without limitation, features are shown as substantially smooth and uniform when in practice, manufacturing variances and abnormalities would occur as is known to those of ordinary skill in the art.

In FIG. 1, a reclosable pouch 50 has a tactile enhancement mechanism of the present invention that includes at least one additional layer of material added to the exterior surface of the pouch and acts to enhance the tactile sensation to a user's fingers and acts as a guiding mechanism such that a user can properly position his/her fingers for occlusion. The pouch 50 has a first sidewall 52 and a second sidewall 54 that are connected by, for example, folding, heat sealing, and/or an adhesive, along three edges 56, 58, 60 to define an interior space 62 between the first and second sidewalls 52, 54. An opening 64 defining a mouth that allows access into the interior space 62 is located along a top edge 66 where the first and second pouch sidewalls 52, 54 are not connected. The first and second sidewalls 52, 54 are preferably made of thermoplastic, such as polyethylene, polypropylene, and blends of such constituents, may include other additives as desired, and may be extruded and formed in any suitable manner known in the art. The sidewalls 52, 54 may be made of and/or include other flexible materials, such as paper, foil, and/or cloth.

A closure mechanism 68 extends longitudinally adjacent the top edge 66 and includes a first elongate closure strip 70 and a second elongate closure strip 72 that can be sealed together along the length of the opening 64 to close the mouth. The first closure strip 70 is disposed along an inside surface of the first sidewall 52 near the opening 64 and extends to the side edges 56, 60 of the pouch 50, and the second closure strip 72 is disposed along an inside surface of the second sidewall 54 near the opening 64 and also extends between side edges 56, 60 of the pouch 50. The closure strips 70, 72, are substantially aligned opposite each other such that the opening 64 may be repeatedly opened and/or closed, preferably thereby respectively sealing and unsealing same. The closure mechanism 68 and the closure strips 70 and 72 thereof may take many different forms suitable for closing the opening 62, some of which are exemplified herein, and the invention is not necessarily limited to any particular form of the embodiments illustrated. Preferably, the closure mechanism 68 is a "pinch and seal" type interlocking "zipper" closure, wherein each of the first and second closure strips 70, 72 has one or more mutually interlocking elongate profiles, and wherein each profile has a substantially constant cross-section that extends completely between side edges 56, 60 of the pouch 50. The closure mechanism 68 may include mutually interlocking profiles of various different designs, such as male and female closure profiles, hook profiles, rib and groove profiles, etc.; however, other types, sizes, and shapes of closure mechanisms sufficient to close the mouth of a bag may be used, such as adhesive closures and/or hook-and-loop type closures. Still further, the closure mechanism 68 may be attached to the pouch 50 in any manner suitable to effectuate closing of the mouth. Illustratively, the closure strips 70, 72 may be formed integrally with the sidewalls 52, 54, may be formed separately and subsequently attached to the sidewalls 52, 54, or any combination thereof using any number of suitable methods including heat sealing, integral casting, adhesive sealing, and various hybrid methods of manufacturing. Some exemplary pouches and closure mechanisms usable in the invention are disclosed in Dais et al. U.S. Pat. No. 5,070,584, Dias et al. U.S. Pat. No. 5,307,552, Ausnit U.S. Pat. No. 5,382,094, Borchardt et al. U.S. Pat. No. 5,774,955, Bench U.S. Pat. No. 6,877,898, Pawloski U.S. Pat. No. 7,410,298, and Dowd et al. U.S. Patent Application Publication No. 2008/0159662, each of which is incorporated by reference in its entirety herein.

The tactile enhancement mechanism is attached to an exterior side of the pouch 50 adjacent to and offset laterally up and/or down from the closure mechanism 68. The tactile enhancement mechanism includes one or more tactile strips 74*a*, 74*b*, 74*c*, 74*d*, each formed of one or more layers of material attached to the exterior surface pouch 50 with an optionally textured outer surface that is exposed to a user's fingers when closing the closure mechanism 68 and located to help provide a unique tactile sensation to the user's fingers over the closure strips 70 and/or 72. First and third tactile strips 74*a* and 74*c* are disposed on respective sidewalls 52, 54 in a region immediately below the first and second closure strips 70, 72, and second and fourth tactile strips 74*b* and 74*d* are disposed on the sidewalls 52, 54 in a region immediately above the first and second closures 70, 72. Preferably, the tactile strips 74*a*-74*d* have the form of elongate strips that extend approximately parallel with and along the entire length of the closure mechanism 68, although the tactile strips 74*a*-74*d* are not necessarily limited to any particular exact shape herein. An exterior surface of each or any of tactile strips 74*a*-74*d* may be textured in any form sufficient to provide an additional tactile feedback cue to the user, such as with bumps, ribs, notches, slits, cuts, embossing, roughening, designs, holes, abscesses, and indentations. An exemplary texture shown in FIG. 1 is a series of X-shaped indentations that may be formed by embossing or cutting partly or completely through the layer(s) of material of the tactile strips. Other patterns that provide some sort of texture transverse to the axes of the strips 74*a*-74*d*, such as vertical, slanted, circular, or diamond shaped cuts or ridges, may be used and are contemplated to be within the scope of the disclosure. The tactile strips 74*a*-74*d* of the tactile enhancement mechanism help ensure positive closure of the closure mechanism 68 by providing both a shape that urges the user's fingers to a position directly opposite the closure mechanism 68 and a tactile cue that provides additional tactile feedback to the user to easily feel where the outer bounds of the closure strips 70 and/or 72 are and where the user's finger's should be to ensure successful closure of the closure mechanism 68. The tactile enhancement mechanism may have alternate forms wherein fewer than four of the tactile strips 74*a*-74*d* may be used, such as having only tactile strips 74*a* and 74*b* on the pouch wall 52, having only lower tactile strips 74*a* and 74*c*, having only upper tactile strips 74*b* and 74*d*, or other combinations of the tactile strips 74*a*-74*d*. It should be understood that the term "layer" encompasses any amount, shape, and/or size of material that is applied to the pouch 50 that provides a tactile sensation to a user's fingers when closing the closure mechanism consistent with the description and objects discussed herein. The tactile enhancement mechanism may also urge the user's fingers into a position directly opposite the closure strips 70, 72 by providing a flat, smooth area 76 coextensive with the closure mechanism 68 over which the user's fingers slide more readily and bounded on one or both sides of the closure mechanism 68 by the tactile strips.

The tactile strips 74*a*-74*d* may be formed of many different materials and/or applied in different ways. For example, the tactile strips 74*a*-74*d* may be made of thermoplastic, such as polyethylene, polypropylene, and blends thereof. The tactile strips 74*a*-74*d* may be made of paint, ink, paper, cloth, adhesive decals, or other material suitable for the purposes described herein. Further, the tactile strips 74*a*-74*d* may be attached to the pouch 50 by any method suitable for application, such as by extrusion, heat sealing, adhesive, spraying, and/or printing. In one example, the tactile strips 74*a*-74*d* are formed by extruding a layer or bead of thermoplastic onto the pouch and subsequently embossing or cutting exterior surfaces of the tactile strips 74*a*-74*d* with an embossing wheel or cutting mechanism. In another example, the layer(s) of material of the tactile strips 74*a*-74*d* may be ink or thermoplastic that is sprayed onto the pouch 50 in a series of shapes adjacent to the closure mechanism, for example with a hot melt adhesive application system. In another example, the layer(s) of material of the tactile strips 74*a*-74*d* may be printed on to the pouch 50 in a series of shapes adjacent to the closure mechanism using flexographic printing machine. Further, the layer (s) of the tactile strips 74*a*-74*d* may be applied in any thickness sufficient to provide a meaningful tactile feel to an average user's fingers as described. Preferably the layers are between about 0.005 mm to about 5 mm thick, and more preferably about 0.02 mm thick.

In one standard method of use, when it is desired to close the closure mechanism 68, the closure strips 70, 72 are squeezed together between a user's fingers 78, 80, for example, beginning at one end of the closure mechanism and drawing the fingers along the entire length of the closure mechanism 68 to thereby squeeze the closure strips 70, 72 together along the entire length thereof. The added layer(s) of material of the tactile enhancement mechanism may guide the user's fingers 78, 80 onto the smooth regions 76 opposite the closure strips 70, 72, thereby guiding the user's fingers 78, 80 into an optimal position for successfully closing the closure strips 70, 72 as the user moves fingers 78, 80 from edge 60 to edge 56, for example, while applying inward pressure to successfully close the pouch 50. Further, a textured exterior surface of the tactile strips 74*a*-74*d* as disclosed herein, also provides a tactile sensation in the form of a roughened sensation that provides the user with additional tactile feedback that signals to the user whether his/her fingers 78, 80 are correctly positioned in the smooth space 76 directly opposite and aligned with the closure mechanism 68.

Figure 2:
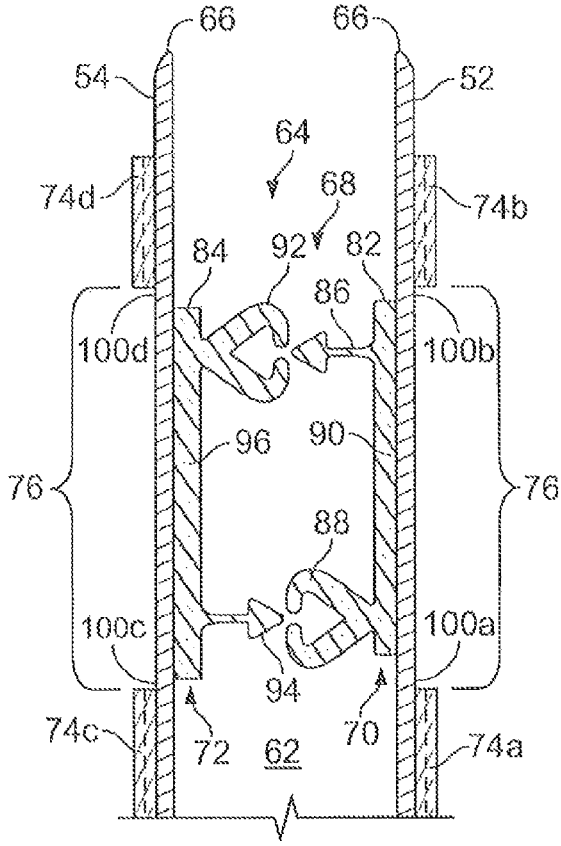
FIG. 2 is a cross-sectional view of an exemplary closure mechanism usable with the tactile enhancement mechanism, taken generally along the lines 2-2 of FIG. 1, with portions behind the plane of the cross section omitted for clarity.

Turning now to some exemplary embodiments shown in FIGS. 2-5, in FIG. 2, the first closure strip 70 includes a first base 82 attached to an interior surface of the first sidewall 52, and the second closure strip 72 includes a second base 84 attached to an interior surface of the second sidewall 54. In other embodiments, one or both of the first and second closure strips 70, 72 may be integral with the respective first and second sidewalls 52, 54. The first closure strip 70 includes a first interlocking member 86 that has an arrow shape disposed at a first end of the first base 82, a second interlocking member 88 that has a channel shape disposed at a second end of the first base 82, and a medial portion 90 between the first interlocking member 86 and the second interlocking member 88, wherein the first interlocking member 86 and second interlocking member 88 both extend from the first base 82 toward the second base 84. The second closure strip 72 includes a third interlocking member 92 that has a channel shape disposed at a first end of the second base 84, a fourth interlocking member 94 that has an arrow shape disposed at a second end of the second base 84, and a medial portion 96 between the third interlocking member 92 and the fourth interlocking member 94, wherein the third interlocking member 92 and the fourth interlocking member 94 extend from the second base 84 toward the first base 80. The first interlocking member 86 occludes with the third interlocking 92 member and the second interlocking member 88 occludes with the fourth interlocking member 94. Although the closure strips 70 and 72 are shown with two sets of interlocking profiles, it is contemplated that any number and combination of interlocking profiles sufficient to close the opening 64 may be used. Each of the tactile strips 74*a*-74*d* is disposed adjacent one of the closure strips 70, 72, and flat, smooth regions 76 are formed immediately opposite and coextensive with the closure strips 70, 72 between the tactile strips. The tactile strips 74*a*-74*d* are preferably spaced above and below the closure mechanism 68 such that, for example small gaps 100*a*-100*d* are formed between the first and second ends of bases 82, 84 and the respective tactile strips 74*a*-74*d*. The gaps 100*a*-100*d* are preferably each between about 0.1 mm to about 10 mm, and more preferably between about 0.5 mm to about 2 mm.

Figure 3:
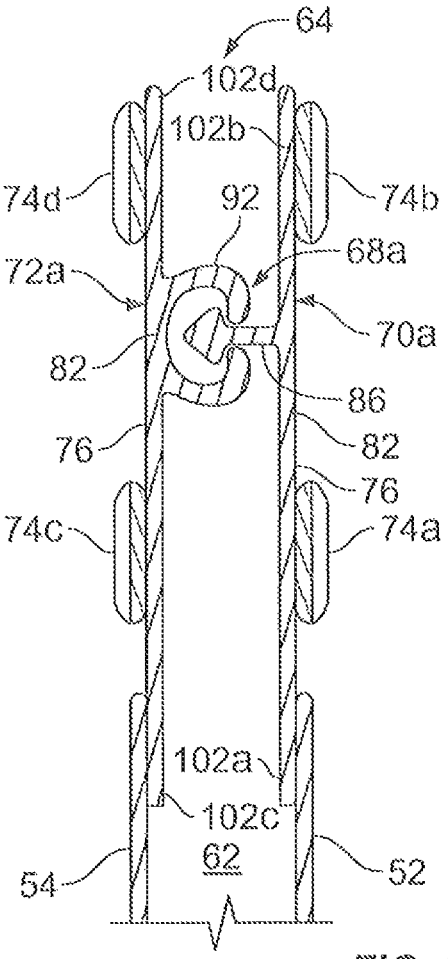
FIG. 3 is a cross-sectional view of a different exemplary closure mechanism with the tactile enhancement mechanism, taken generally along the lines 2-2 of FIG. 1, with the closure mechanism closed and portions behind the plane of the cross section omitted for clarity.

In FIG. 3, a tactile enhancement mechanism on a pouch 50 is shown with another closure mechanism 68*a* including closure strips 70*a*, 72*a* having a different profile. The closure mechanism 68*a* has first and second closure strips 70*a*, 72*a* that extend along the length of the opening 64. Each closure strip 70*a*, 72*a* has a profile defining an interlocking member 86 or 92 projecting from an inside surface of a base member 82. Upper and lower flange members 102*a*, 102*b*, 102*c*, 102*d* extend upwardly and downwardly from a respective base member 82 and each lower flange member 102*a*, 102*c* is secured to a respective sidewall 52, 54 of the pouch 50 along the opening 64 such that the first closure strip 70*a* occludes with the second closure strip 72*a*.

Tactile strips 74*a*, 74*b*, 74*c*, and 74*d* defining a tactile enhancement mechanism are attached to the exterior surfaces of the upper and lower flange members 102 in the manner shown in FIG. 1. The first tactile strip 74*a* is spaced below the interlocking member 86, and the second tactile strip 74*b* is spaced above the interlocking member 88, thereby leaving an intermediate flat, smooth region 76 coextensive with the interlocking member. Optionally, third and fourth tactile strips 74*c*, 74*d* may be attached to the exterior surfaces of the opposite upper and lower flanges 102*c*, 102*d*, with the third tactile strip 74*c* spaced below the interlocking member 92 and the fourth tactile strip 74*d* spaced above the interlocking member and another flat, smooth region 76 disposed therebetween.

Figure 4:
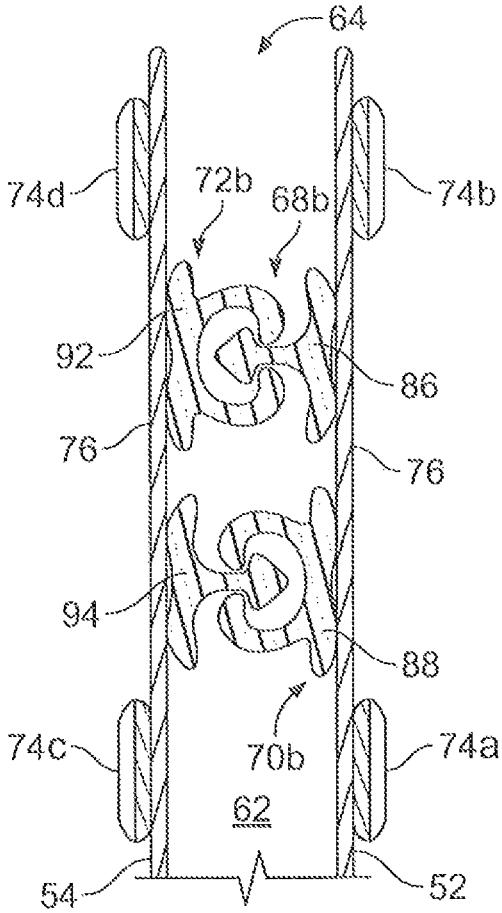
FIG. 4 is a cross-sectional view of another exemplary closure mechanism with the tactile enhancement mechanism, taken generally along the lines 2-2 of FIG. 1 with the closure mechanism closed and portions behind the plane of the cross section omitted for clarity.

In FIG. 4, a tactile enhancement mechanism on a pouch 50 with a further closure mechanism 68*b* is generally similar to closure mechanism 68, but includes closure strips 70*b*, 72*b* having yet a different profile. Closure strip 70*b* includes upper and lower interlocking members 86 and 88, and closure strip 70*b* includes upper and lower interlocking members 92 and 94. The upper interlocking members 86, 92 are spaced apart from the lower interlocking members 88, 94 and extend along the length of the closure mechanism 68*b*. Each interlocking member 86, 88, 92 and 94 is attached directly to an inside surface of a sidewall 52 or 54 of the pouch 50 along the opening 64 such that the upper interlocking members 86 and 92 occlude together and the lower interlocking members 88 and 94 occlude together. Tactile strips 74*a*, 74*b*, 75*c*, 74*d* of the tactile enhancement mechanism are attached to exterior surfaces of the sidewalls 52 or 54 of the pouch 50. The tactile strip 74*b* is spaced above the closure mechanism, and the tactile strip 74*a* is spaced below the closure mechanism, thereby leaving a flat, intermediate smooth region 76 coextensive with the interlocking members 86, 88, where the sidewall 52 of the pouch 50 is exposed with no tactile strip. Optionally, the tactile strips 74*c* and 74*d* may be attached to the exterior surface of the opposite sidewall 54 of the pouch 50, with the tactile strip 74*d* spaced above the closure mechanism and the tactile strip 74*c* spaced below the closure mechanism, thereby leaving a flat, smooth portion 76 of the sidewall 54 therebetween opposite the interlocking members 92, 94. Preferably, the tactile strips 74*a*-74*d* extend parallel to and along the entire length of the closure mechanism 68*b* as shown in FIG. 1.

Each tactile strip 74*a*-74*d* shown in FIGS. 2-4 preferably has a textured exterior surface, such as formed by slices, slits, indentations, holes, or other texture that may be readily felt by a user's fingers along the exterior side thereof, as described with respect to FIG. 1. The tactile strips 74*a*-74*d* may be formed of a bead of material that is applied to the exterior of the pouch, such as thermoplastic extruded directly on to a side wall, may be a strip of material that is post-applied to the exterior of the pouch, or may be formed by any other method sufficient to secure the layer(s) of material to the exterior of a pouch adjacent to the closure mechanism, as described previously herein. Further, the tactile strips 74*a*-74*d* preferably are not aligned directly opposite (behind) the closures 70, 72, such as the bases 82, 84 of FIG. 2, or the interlocking profiles of FIGS. 3 and 4, and the flat, smooth regions 76 include substantially no material added to the sidewalls of the pouch.

Figure 5:
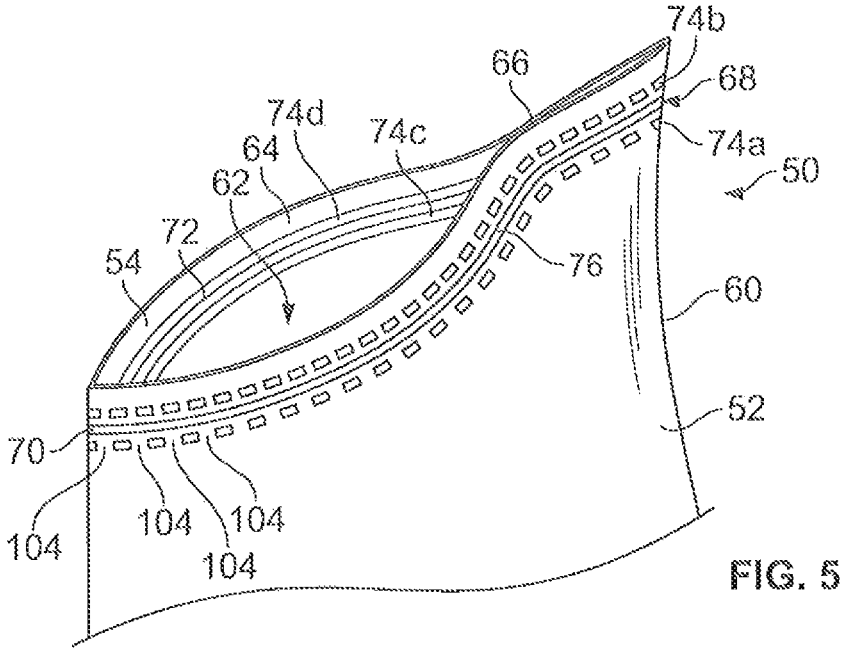
FIG. 5 is a fragmentary isometric view of a pouch with another variation of the tactile enhancement mechanism.

In a further embodiment shown in FIG. 5, the tactile enhancement mechanism comprises at least one, and preferably two tactile strips 74*a*, 74*b*, wherein the tactile strips extend along the length of the sidewalls 52, 54 in a region immediately above and/or below the first closure profile 70 and are discontinuous. A flat, smooth region 76 is defined between the tactile strips 74*a*, 74*b* coextensive with the closure mechanism 68 as disclosed previously herein. The tactile strips 74*a*, 74*b* are discontinuous, having breaks 104 disposed at intervals along the length of the pouch 50 as shown in FIG. 5. The intervals between successive breaks 104 can be constant or irregular. The breaks 104 in the tactile strips 74*a*, 74*b* may provide the textured surface alone, or additional texturing may be imparted to the tactile strips in any manner as suggested herein. The tactile strips 74*a*, 74*b* may be disposed only on one sidewall 52 of the pouch 50 (as shown in FIG. 5) or additional tactile strips (not shown) may be disposed in similar position with respect to the closure mechanism on both pouch 50 sidewalls 52, 54 as disclosed previously herein. Some of the tactile strips 74*a*-74*d* may be continuous as shown in FIG. 1 and others of the tactile strips may be discontinuous as shown in FIG. 5.

Tactile Strips

Figure 6:
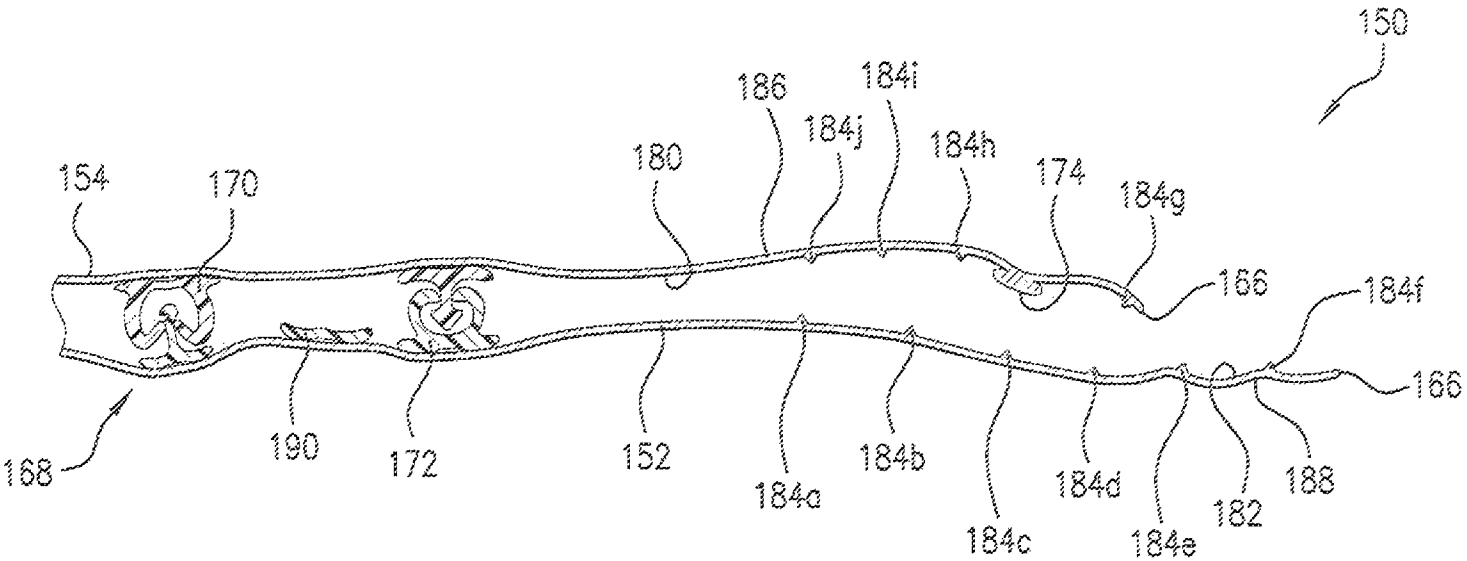
FIG. 6 is a partial cross-sectional view of another exemplary closure mechanism with a tactile enhancement mechanism in accordance with the subject technology.

Referring now to FIG. 6, a partial cross-sectional view of another exemplary pouch 150 having a tactile enhancement mechanism in accordance with the subject technology is shown. As will be appreciated by those of ordinary skill in the pertinent art, the pouch 150 utilizes similar principles such as the closure strips 70, 72 of the pouch 50 described above. Accordingly, like reference numerals preceded by the numeral "1" are used to indicate like elements when possible. The primary difference of the pouch 150 in comparison to the pouch 50 is an arrangement of tactile strips. It is also noted that the first closure strip 170 has a male interlocking member 194 that is hooked shaped rather than arrowhead shaped. In various embodiments, the interlocking member 194 as well as other components of the closure strips 170, 172 may be intermittently varied to produce sound during closing and other desirable benefits in accordance with the technology disclosed in U.S. Ser. No. 12/950,350, filed on Nov. 19, 2010.

A continuous line 190 of resin is intermediate the closure strips 170, 172. The resin line 190 provides additional color and facilitates sealing between the closure strips 170, 172 when forming a side weld during manufacture of the pouch 150.

The features that comprise the tactile enhancement mechanism are on the internal surfaces 180, 182 of the sidewalls 152, 154 between the top edges 166 and closure strips 170, 172. The tactile enhancement mechanism includes ridges 184*a*-184*j* and a tactile strip 174. In alternative embodiments, one or more such ridges and tactile strips may be additionally on the external surfaces 186, 188 or only on the external surfaces 186, 188.

The tactile strip 174 is only on one panel or sidewall 154, which is relatively shorter than the other sidewall 152. Rather than be adjacent the closure mechanism 168 as shown above, the tactile strip 174 is much closer to the respective top edge 166. The tactile strip 174 extends approximately parallel with and along the entire length of the closure mechanism 168 as do the ridges 184*a*-184*j*.

The ridges 184*a*-184*j* are configured to provide improved gripping, feel and user satisfaction when opening and closing the pouch 150. Although the ridges 184*a*-184*j* are not necessarily limited to any particular exact shape or arrangement herein, the ridges 184*a*-184*j* are somewhat triangular in cross-sectional shape. An exterior surface of each or any of the ridges 184*a*-184*j* may be textured in any form sufficient to provide an additional tactile feedback cue to the user.

An exemplary arrangement is shown in FIG. 6 with ridges 184*a*-184*f* equally spaced on the longer sidewall 152, ridge 184*g* adjacent the top edge 166 of the shorter sidewall 154, and ridges 184*h*-184*j* equally spaced closer to the closure mechanism 168 than the tactile strip 174. The spacing of ridges 184*h*-184*j* may be the same or slightly closer, as shown, than the opposing ridges 184*a*-184*f*. In one embodiment, the spacing between the ridges 184*a*-184*f* is approximately 0.060 of an inch {0.001524 mm}. The tactile enhancement mechanism may have alternate forms wherein fewer or more than ten ridges and a plurality of the tactile strips 174 may be used.

The ridges 184*a*-184*j* may be formed of many different materials and/or applied in different ways. For example without limitation, the ridges 184*a*-184*j* may be made of thermoplastic, such as polyethylene, polypropylene, and blends thereof in an integrally formed process or post-applied. Further, the ridges 184*a*-1843 may be attached to the pouch 150 by any method suitable for application, such as by extrusion, heat sealing, adhesive, spraying, and/or printing. Still further, the ridges 184*a*-184*j* may be varied in color such as ridges 184*a*-184*f* being blue and ridges 184*g*-184*j* being pink to provide further visual cue to the user. In one embodiment, the height of the ridges 184*a*-184*f* is approximately 0.005 of an inch {0.00127 mm} to 0.007 of an inch {0.001778 mm}.

Figure 7:
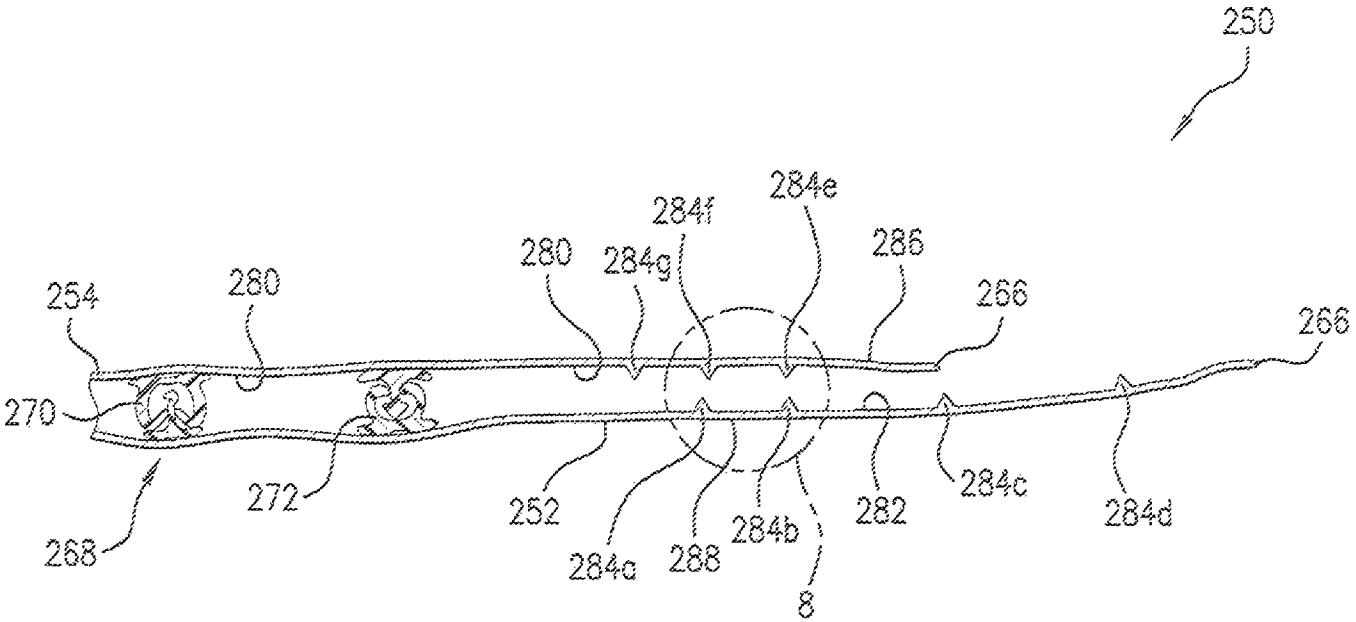
FIG. 7 is a partial cross-sectional view of still another exemplary closure mechanism with a tactile enhancement mechanism in accordance with the subject technology.

Referring now to FIG. 7, a partial cross-sectional view of still another exemplary pouch 250 with a tactile enhancement mechanism in accordance with the subject technology is shown. As will be appreciated by those of ordinary skill in the pertinent art, the pouch 250 utilizes similar principles to the pouches 50, 150 described above. Accordingly, like reference numerals preceded by the numeral "2" are used to indicate like elements when possible. The primary differences of the pouch 250 in comparison to the pouch 150 is the well defined triangular cross-sectional shape and arrangement of ridges 284*a*-284*e* and the absence of tactile strips.

The ridges 284*e*-284*g* are equally spaced on the shorter sidewall 254 and set apart approximately double the spacing from the respective top edge 266. Ridges 284*a*, 284*b* oppose ridges 284*e*, 284*f* and are spaced approximately the same distance apart. However, the spacing from ridge 284*b* to ridge 284*c* approximately doubles with the spacing from ridge 284*c* to ridge 284*d* increasing about another 12%. In one embodiment, the spacing between the ridges 284*e*-284*g* is approximately 0.070 of an inch {0.01778 mm}.

Figure 8:
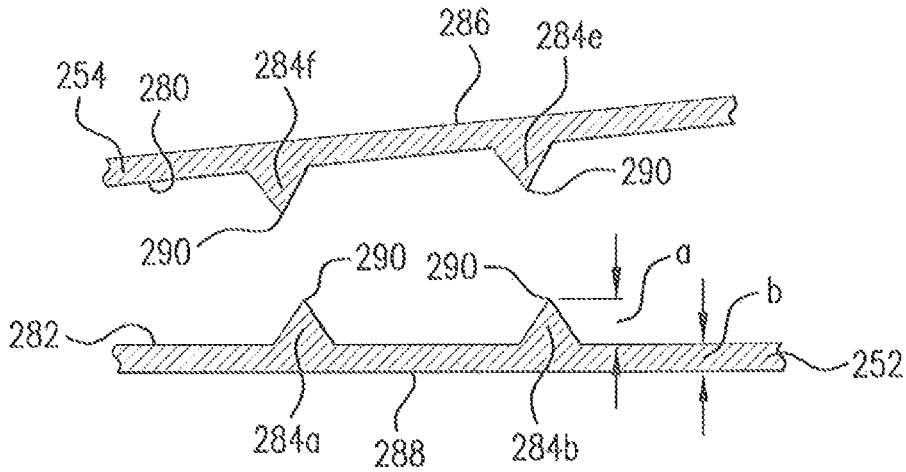
FIG. 8 is an enlarged partial cross-sectional view of the area surrounded by circle 8 of FIG. 7.

Referring now to FIG. 8, an enlarged partial cross-sectional view of the area surrounded by circle 8 of FIG. 7 is shown. In particular, ridges 284*a*, 284*h*, 284*e*, 284*f* are shown in detail. The ridges 284*a*-284*g* are substantially equilateral triangles in cross-sectional shape having a height "a" approximately double the thickness "b" of the respective sidewall 252, 254. Hence, a ratio of height "a" to sidewall thickness "b" is approximately two. The ridges 284*a*-284*g* are well formed so that the distal end 290 of each ridge 284*a*-284*g* is pointed or sharp to provide concentrated and significant tactile feedback to the user. In one embodiment, the height "a" is approximately 0.014 of an inch {0.3556 mm} to 0.015 of an inch {0.381 mm}. Preferably, the ridges 284*a*-284*g* are extruded from a die and post applied to the sidewalls 252, 254.

The arrangement and size of the ridges 284*a*-284*g* is particularly well-suited to improve tactile performance under moist or wet conditions. Further, under typical use, although the larger well-formed ridges 284*a*-284*g* would be expected to decrease the user contact area and, in turn, reduce the ability to grip the sidewall 252, 254. However, the placement of the ridges 284*a*-284*g* and the user response to the shape of the ridges 284*a*-284*g*, creates a surprisingly improved gripping experience.

It is also noted that the sidewall material impacts the performance of the tactile response to the user. For example, a high gloss panel or film provides additional contact area as compared to an embossed or other types of film. The sidewall material should be selected to take advantage of the synergy between the film and the ridge shape and arrangement. It is envisioned that a low or regular gloss film may provide the best overall tactile enhancement mechanism. A high gloss film typically has a low haze. The American Society for Testing and Materials maintains a Standard Test Method for Specular Gloss of Plastic Films and Solid Plastics (ASTM D2457). To determine gloss for films exhibiting intermediate gloss, measurements are made at a 60° angle, for high-gloss films at a 20° angle, a 45° angle may also be used as a third option recognized by ASTM D2457. A black glass standard is used for calibration purposes. A primary black glass standard with an index of refraction of 1.540 and a scale factor of 10.0 should theoretically yield a value of 95.8 gloss units at 60° according to ASTM D2457. A perfect mirror would yield 1000, i.e. 100% reflectance*10.0. ASTM D2457 notes that clear plastic films can yield gloss values greater than 100 units because of reflections from both surfaces. Preferred bag films yield gloss values covering the range of 50 to 175 gloss units and, more preferably 70 to 125 gloss units. A high gloss film example is less than 20% haze and a gloss greater than 50 Hunter Units (H.U.) at 45 degrees. Advantageously, some preferred embodiments may have very different haze and gloss values. In one embodiment, the film is a low gloss film with at least 20% haze and a gloss of less than 50 H.U. and, more preferably, a haze of from 22-33% with a gloss of from 37-47 H.U. In another embodiment, the film is a high gloss film with less than 15% haze and a gloss of more than 55 H.U. and, more preferably, a haze of from 5-15% with a gloss of from 55-75 H.U.

Figure 9:
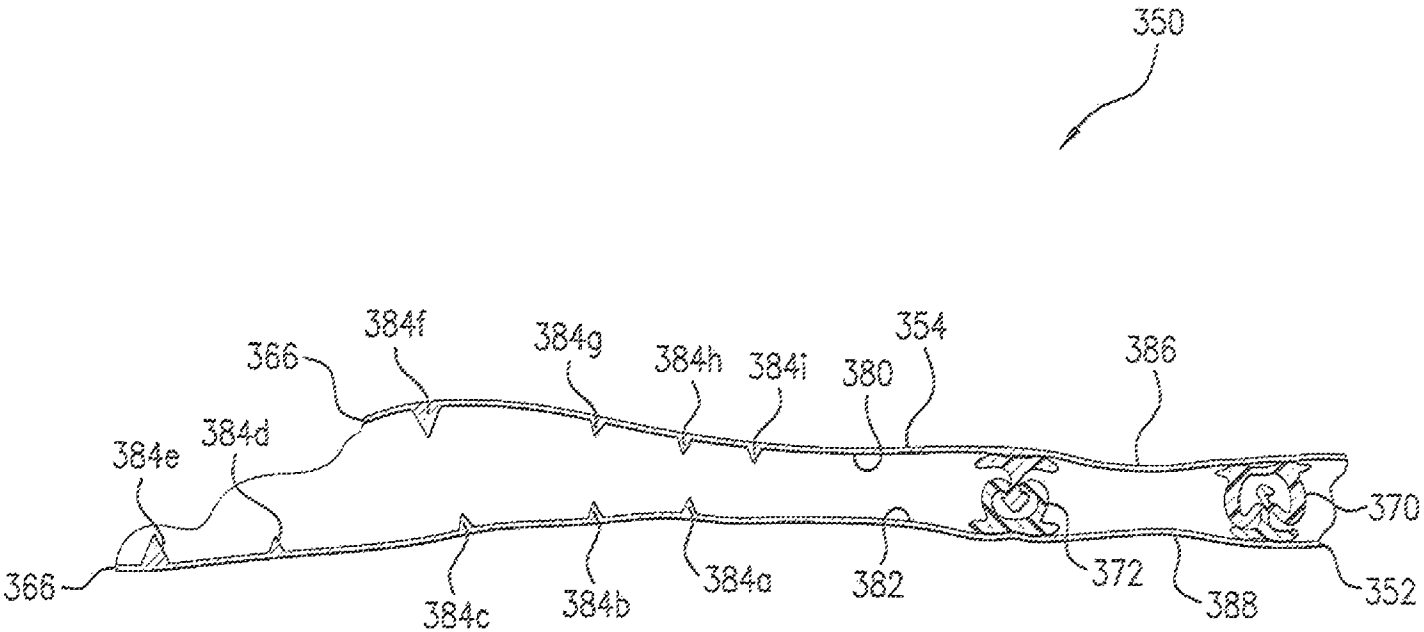
FIG. 9 is a partial cross-sectional view of yet another exemplary closure mechanism with a tactile enhancement mechanism in accordance with the subject technology.

Referring now to FIG. 9, a partial cross-sectional view of yet another exemplary pouch 350 with a tactile enhancement mechanism in accordance with the subject technology is shown. As will be appreciated by those of ordinary skill in the pertinent art, the pouch 350 utilizes similar principles to the pouches 50, 150, 250 described above. Accordingly, like reference numerals preceded by the numeral "3" are used to indicate like elements when possible. The primary difference of the pouch 350 in comparison to the pouch 250 is the arrangement of ridges 384*a*-384*i* and that two of the ridges 384*e*, 384*f* are significantly larger than the other ridges 384*a*-384*d*, 384*g*-384*i*.

The ridges 384*g*, 384*h* are spaced approximately the same as the ridges 284*e*, 284*f* of FIG. 7 noted above. However, the ridges 384*h*, 384*i* are relatively more closely spaced than the ridges 384*g*, 384*h*. For example, the spacing between ridges 384*h*, 384*i* is approximately 75% of the spacing between the ridges 384*g*, 384*h*. In one embodiment, the spacing between ridges 384*g*, 384*h* is at least 25% more than the spacing between the ridges 384*h*, 384*i*. In one embodiment, the spacing between ridges 384*g*, 384*f* is at least 75% more than the spacing between the ridges 384*g*, 384*h*. In another embodiment, the spacing between ridges 384*g*, 384*f* is 75% to 125% more than the spacing between the ridges 384*g*, 384*h*.

Sidewall 354 also has the additional fourth ridge 384*f* near the respective top edge 366. The ridge 384*f* is significantly larger than the other ridges 384*g*-384*i*. In one embodiment, the height of the ridge 384*f* is approximately 0.017 of an inch {0.4318 mm} whereas the height of the ridges 384*g*-384*i* is approximately 0.014 of an inch {0.3556 mm} to 0.015 of an inch {0.381 mm}.

The longer sidewall 352 has ridges 384*a*, 384*b* which are spaced similarly to and oppose ridges 384*h*, 384*g* on the shorter sidewall 354. However, the spacing from ridge 384*b* to ridge 384*c* is approximately 37.5% longer than the spacing from ridge 384*a* to ridge 384*b*. In one embodiment, the spacing between ridges 384*b*, 384*c* is at least 50% more than the spacing between the ridges 384*a*, 384*b*. The spacing from ridge 384*c* to ridge 384*d* is approximately double the spacing from ridge 384*a* to ridge 384*b*. In one embodiment, the spacing between ridges 384; 384*d* is at least 75% more than the spacing between the ridges 384*a*, 384*b*. The spacing from ridge 384*e* to ridge 384*d* is approximately 50% longer than the spacing from ridge 384*a* to ridge 384*b*. In one embodiment, the spacing between ridges 384*e*, 384*d* is at least 25% more than the spacing between the ridges 384*a*, 384*b*. In one embodiment, the spacing between the ridges 384*a*, 384*b* is approximately 0.070 of an inch {0.01778 mm}. The spacing between any of the ridges 384*a*-*i* may vary through a variety of values such as at least 10%, 25%, or 50% as well as within ranges such as 10-50%, 25-75%, 50-200% or greater and the like in order to optimize tactile response and grip. In another embodiment, there are three grip strips on one sidewall spaced approximately 0.153, 0.100 and 0.071 of an inch starting from the lip and four on the other sidewall spaced approximately 0.113, 0.090, 0.188 and 0.147 of an inch.

Similar to the shorter sidewall 354, the ridge 384*e* adjacent the top edge 366 of the longer sidewall 352 is relatively larger, which is substantially the same size as ridge 384*f*. In one embodiment, the height of the ridges 384*e*, 384*f* is at least 10% larger than each of the other ridges 384*a*-*c*, 384*g*-*i*. In another embodiment, the height of the ridges 384*e*, 384*f* is about 20% larger than each of the other ridges 384*a*-*c*, 384*g*-*i*. The height of any of the ridges 384*a*-*i* may vary through a variety of values such as at least 5%, 10%, 15%, or 20% as well as within ranges such as 5-10%, 5-25%, 10-20%, 15-25%, 20-25%, 15-50% or greater and the like in order to optimize tactile response and grip.

In one embodiment, the ridges 384*e*, 384*f* are extruded with the respective sidewall 352, 354 whereas the other ridges 384*a*-384*d*, 384*g*-384*i* are post applied. Various combinations of extrusion and post application of the ridges can be utilized to accomplish various combinations and sizes of ridges.

Any of the tactile enhancement mechanisms disclosed herein may be manufactured in a variety of shapes and sizes and may take various forms sufficient to provide the functions disclosed herein. Additionally, the ridges may be utilized on external surfaces of the sidewalls as well as externally and internally on the same pouch. However, the embodiments shown herein have been proven to be an improvement over the prior art. More particularly, even within the embodiments shown, the lip of the pouch 350 of FIG. 9 has yielded improved test results under a non-slip grip force (NSGF) testing than the lip of the pouch 250 of FIG. 7. Similarly, the lip of the pouch 350 of FIG. 7 has yielded improved test results under a non-slip grip force testing than the lip of the pouch 150 of FIG. 6.

In one assessment, the lips of each sidewall 152, 154, 252, 254, 352, 354 of the pouches 150, 250, 350, respectively, were subjected to NSGF measurements. The approximate results are reproduced below in Table 1 with lower NSGF numbers being preferred. As can be seen from Table 1, the pouch 250 of FIG. 7 is an approximately 10% improvement over the pouch 150 of FIG. 6. Further, the pouch 350 of FIG. 7 is an approximately 15% improvement over the pouch 150 of FIG. 6. Without being limited to any particular theory, these surprising results the NSGF test results that indicate significant consumer benefits are produced by the size, shape, quantity and location of the ridges 284, 384.

TABLE 1

| Embodiment | Sidewall | NSGF value |
|---|---|---|
| FIG. 6 | 152 | 1.38 |
| FIG. 6 | 154 | 1.47 |
| FIG. 7 | 252 | 1.27 |
| FIG. 7 | 254 | 1.32 |
| FIG. 9 | 352 | 1.22 |
| FIG. 9 | 354 | 1.20 |

INCORPORATION BY REFERENCE

All patents, published patent applications and other references disclosed herein are hereby expressly incorporated in their entireties by reference.

INDUSTRIAL APPLICABILITY

A tactile enhancement mechanism of the present invention may help guide a user's fingers into the proper position along a closure mechanism to ensure complete and/or proper closure of the closure mechanism by providing tactile cues and feedback that help a user place his/her finger's in an optimal position for effectuating closure. A tactile enhancement mechanism placed at locations adjacent above and/or below the closure mechanism can in some cases also overcome one or more challenges of the prior art discussed herein.

While specific embodiments are discussed herein, it is understood that the present disclosure is to be considered only as an exemplification of the principles of the disclosure. Numerous modifications to the present disclosure will be apparent to those skilled in the art in view of the foregoing description without departing from the principles of the disclosed invention. Accordingly, this description is to be construed as illustrative only and is presented for the purpose of enabling those skilled in the art to make and use the disclosure and to teach the best mode of carrying out same.

We claim:

1. A reclosable pouch comprising:

a first sidewall;

a second sidewall opposing the first sidewall and sealed thereto to form a closed distal portion defining an interior that is accessible by a proximal opening;

a closure profile along an interior surface of the opposing sidewalls for selectively sealing the proximal opening, wherein the closure profile substantially extends a length of the proximal opening;

first, second and third ridges disposed on an interior surface of the first sidewall between the closure profile and the proximal opening;

first, second, third and fourth ridges disposed on an interior surface of the second sidewall between the closure profile and the proximal opening, wherein first and second ridges on the second sidewall oppose and are equally spaced with the second and third opposing ridges on the first sidewall;

a fourth ridge on the first sidewall being most proximally located; and a fifth ridge on the second sidewall being most proximally located ridge, and wherein:

a spacing between the first and second ridges on the first sidewall is at least 10% less than a spacing between the second and third ridges on the first sidewall;

a spacing between the third and fourth ridges on the first sidewall is at least 75% more than a spacing between the second and third ridges on the first sidewall;

a spacing between the second and third ridges on the second sidewall is at least 25% more than a spacing between the first and second ridges on the second sidewall;

a spacing between the third and fourth ridges on the second sidewall is at least 100% more than a spacing between the first and second ridges on the second sidewall; and a spacing between the fourth and fifth ridges on the second sidewall is approximately equal to the spacing between the second and third ridges on the second sidewall.

2. A reclosable pouch as recited in claim 1, wherein the fourth ridge is a most proximally located ridge and at least 10% larger than each of the first, second and third ridges on the first sidewall; and the fifth ridge is a most proximally located ridge and at least 10% larger than each of the first, second, third and fourth ridges on the second sidewall, wherein each ridge forms a sharp distal point.

3. A reclosable pouch as recited in claim 1, wherein the first and second sidewalls are fabricated from a low gloss film.

4. A reclosable pouch as recited in claim 1, wherein the first and second sidewalls are fabricated from a film yielding gloss values within the range of 50 to 175 gloss units.

5. The reclosable pouch as recited in claim 1, wherein each ridge has a well-formed triangular cross-sectional shape.

6. The reclosable pouch as recited in claim 5, wherein the well-formed triangular cross-sectional shape is equilateral.

7. The reclosable pouch as recited in claim 5, wherein the well-formed triangular cross-section has a height from the respective sidewall approximately double a thickness of the respective sidewall.

8. The reclosable pouch as recited in claim 1, wherein the ridges are formed on at least one tactile strip that is post-applied to the respective sidewall.

* * * * *